United States Patent [19]

Jorno

[11] Patent Number: 4,846,464

[45] Date of Patent: Jul. 11, 1989

[54] DUMBBELL AND GYMNASTIC DEVICE FOR FITNESS AND STRENGTH TRAINING

[76] Inventor: Lars L. Jorno, Stationsvej 13, DK-4241 Vemmelev, Denmark

[21] Appl. No.: 279,313

[22] Filed: Dec. 1, 1988

Related U.S. Application Data

[63] Continuation of Ser. No. 64,305, May 19, 1987, abandoned.

[30] Foreign Application Priority Data

Oct. 1, 1985 [DK] Denmark ..... 4444/85

[51] Int. Cl.[4] ..... A63B 21/18; A63B 11/00

[52] U.S. Cl. ..... 272/119; 272/122

[58] Field of Search ..... 272/67, 68, 117, 119, 272/122, 123, 143

[56] References Cited

U.S. PATENT DOCUMENTS

| | | | |
|---|---|---|---|
| 757,041 | 4/1904 | Hosfeld | 272/67 |
| 1,316,683 | 9/1919 | Calvert | 272/122 |
| 1,677,728 | 7/1928 | Robinson | 272/70 |
| 2,011,362 | 8/1935 | Hayward . | |
| 2,736,034 | 2/1956 | Fredenhagen et al. . | |
| 3,334,899 | 8/1967 | Bosko et al. | 272/123 |
| 3,482,834 | 12/1969 | James | 272/122 |
| 3,838,853 | 10/1974 | Fredenhagen | 272/67 |
| 3,910,577 | 10/1975 | Boyle | 272/119 |
| 4,105,200 | 8/1978 | Unger | 272/67 |
| 4,180,261 | 12/1979 | Kolka | 272/119 |
| 4,189,141 | 2/1980 | Rooney | 272/119 X |
| 4,247,101 | 1/1981 | Gallmeyer | 272/119 X |
| 4,322,072 | 3/1982 | White | 272/119 |
| 4,326,706 | 4/1982 | Guthrie et al. | 272/119 |
| 4,368,883 | 1/1983 | Tiktin | 272/119 X |
| 4,369,967 | 1/1983 | Kimura | 272/119 |
| 4,538,806 | 9/1985 | Wilkerson | 272/122 |
| 4,602,784 | 7/1986 | Budden et al. | 272/119 |
| 4,621,808 | 11/1986 | Orchard et al. | 272/119 |

FOREIGN PATENT DOCUMENTS

| | | | |
|---|---|---|---|
| 607883 | 12/1983 | Denmark . | |
| 83/01201 | 4/1983 | PCT Int'l Appl. | 272/119 |

*Primary Examiner*—Richard J. Apley
*Assistant Examiner*—Robert W. Bahr
*Attorney, Agent, or Firm*—Ladas & Parry

[57] ABSTRACT

A dumbbell consisting of a heavy core (1) around which there is an impact absorbing layer (2) capable of being shaped covered with a splinter-proof layer (3) on which a number of straps or bands (4) is provided.

The impact absorbing layer and the splinter-proof cover that the dumbbells can hit against each other. The dumbbells are also protected by the two layers in case they are dropped—just as the risk of causing bodily injuries if the dumbbell falls down is reduced. Straps or bands on the dumbbell serving the purpose of fastening it to the hand moreover means that the risk of dropping the dumbbell is reduced. The straps/bands furthermore makes it possible to perform faster and longer movements of body and limbs in order to strengthen muscles and circulation without dropping the dumbbells. The construction with the major part of the weight of the dumbbell resting in the hollow of the hand reduces the wear on several of the sinews of the hand by varying courses of movement.

7 Claims, 1 Drawing Sheet

DUMBBELL AND GYMNASTIC DEVICE FOR FITNESS AND STRENGTH TRAINING

Figure 1:
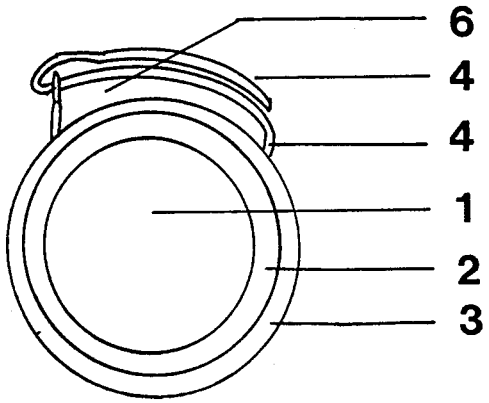

This is a continuation of co-pending application Ser. No. 07/064,305 filed on May 19, 1987, now abandoned, and PCT/DK86/00106 filed Sept. 25, 1986.

The invention relates to a dumbbell, i.e. a handheld exercise device, which has hand-attachment straps or bands in order that it can be used for fast and swinging physical exercises with no risk of slipping off, and a shape and a construction that makes it particularly suited for its purpose.

Dumbbells to be used for muscle training during the performing of physical exercises are known. Dumbbells are normally used for training the body, and particularly the arms, and the dumbbells consist of a handle with a comparatively small diameter and a pair of weight balls or weight discs of a larger diameter attached to the ends of the handle. Dumbbells are usually produced in one piece of cast metal or of several pieces of cast metal that can be screwed together. Such dumbbells are hard and rigid and may cause injuries if they slip off and fall and hit a person's feet or body. The dumbbells also make a noise when they hit against each other. Nor do the traditional dumbbells have straps, which makes them unsuited for use during the performing of physical exercises where several persons simultaneously and in the same room make fast and swinging physical exercises with dumbbells. The dumbbells may thus slip out of the grip of the fingers and cause injuries to persons in the room.

The traditional dumbbells which are made of iron or plastics with a heavy content moreover have the disadvantage that they do not absorb impacts to any significant degree during the performing of exercises where two dumbbells—one in each hand of the user —hit against each other. Moreover, they have the disadvantage that they remain deformation-resistant when held by a person's hand and fingers and therefore cannot adapt themselves to the hand size and hand shape of the individual user.

A serious drawback of the traditional dumbbells is, however, that a great part of the heavy substance of the dumbbell is found outside the half closed hand; this means that the dumbbell will move in an inexpedient manner during rotary and swinging arm movements where the user changes the movement from one level to another in the middle of one course of movement. The design with a great part of the weight of the dumbbell outside the half closed hand furthermore causes great wear of the sinews of the hand, particularly during rotary movements of hand and arms the sinews of persons with little strength in fingers and arms will be subjected to an overload. By pronation and supination around a diagonal axis through the forearm and by different gymnastic exercises with total movements changing between different levels, the use of the traditional available dumbbells will cause a heavy strain on the extensor sinews of the forearm, which for quite a few people has led to tenosynovitis of the extensor sinews of the forearm.

From U.S. Pat. No. 3,482,834 it is known to make dumbbells of a very hard material such as concrete being coated with a yielding plastic. It is likewise known from U.S. patent application No. 537,271 filed 29 Sept. 1983 to make dumbbells with a soft and flexible shell containing a weight yielding material. Such dumbbells provide a certain protection against damage and against unnecessary noise and the risk of injuries. The dumbbells are also softer to the touch than the ordinary metal cast dumbbells. Still, the dumbbells with a plastic surface are hard when they fall down or when they hit against each other because they are deformation-resistant. From U.S. Pat. No. 4,105,200 it is known to make a device for muscle exercise where the instrument by means of a device is attached to the palm of the hand. This instrument is designed, however, with the purpose of training the extensor muscles of the hand and forearm and does not give the opportunity of also training the flexor muscles of the arms due to the low specific gravity of the instrument and consequent low weight. The instrument according to U.S. Pat. No. 4,105,200 does thus not serve the purpose being characteristic of a dumbbell. The device is moreover designed in such a manner that the attachment system must be able to yield; such a device cannot serve the purpose which is to be served by the dumbbell according to this application.

A dumbbell designed with a substance with a high specific gravity and a heavy weight according to model in U.S. Pat. No. 4,105,200 will not secure that the dumbbell does not slip and fall because it is only fastened around the fingers of the hand and not around the wrist. This means that such a dumbbell by a very quick movement in connection with swinging exercises may fall out of the hand. However, for use by physical exercises where a dumbbell is to be swung from one level to another, or where the user wishes to make sudden changes of movement in the course of one movement, a dumbbell with cylindrical shape as the device mentioned above is not particularly suited, because the difference will be felt by a movement of the dumbbell along the longitudinal axis thereof and a movement with the dumbbell along the transverse axis thereof.

U.S. Pat. No. 3,334,899 shows a self-retained and fluid-containing dumbbell body constructed in one piece, and the patent also shows a dumbbell, in which a container contains a liquid or a similar material. However, since the device is very rigid, the main purpose is to enable the dumbbell to be filled to various levels in order thereby to vary the total weight of the device according to the purpose of the exercise. The same applies to the embodiment shown in FIG. 6 of the patent, where rubber balls have such a strength and rigidity that they for instance may be screwed onto the threads of a connecting rod. Consequently, this dumbbell is not soft, flexible and yielding either, which is desirable if a user wishes to make exercises where the dumbbells are to be hit against one another, and if such injuries are to be avoided as are caused by the fall of a dumbbell over a foot.

U.S. patent application Ser. No. 537,271 from 29 Sept. 1983 mentions a dumbbell that is softer and more flexible than the one mentioned above. This dumbbell has, however, still a comparatively hard and deformation-resistant shell, and therefore it may still cause pain and injuries if dropped over a foot. Nor will it be particularly liable to change its shape and absorb any impact during exercises where the two dumbbells hit against each other, just as it will not change its shape to any significant degree when grasped by the fingers of the hand.

Moreover, it is a common feature of all the above mentioned dumbbells and other available dumbbells that they are not particularly suited for gymnastic exercises where fast and swinging exercises are performed, such as exercises changing between different levels and movement patterns. If the above mentioned dumbbells and available dumbbells in general are not particularly suited for this purpose, it is due to the fact that not only do they not have safety straps, but they also move in such a manner that many athletes when using the dumbbells will sense a certain counteracting force when the dumbbells are alternately moved from one movement in the direction of the longitudinal axis of the dumbbell to a movement in the direction parallel to the transverse axis of the dumbbell. In addition to the mentioned drawbacks, the dumbbells mentioned here as well as other available dumbbells are designed in such a manner that the dumbbell has a non-formable handle piece, so that the dumbbell as a consequence will not adjust itself to the different hand shapes of different persons either.

By the present invention a dumbbell is produced, which is extremely useful in connection with fast and swinging exercises or where a change of level or direction is made in the middle of one swinging movement. The dumbbell is very soft and in a special embodiment capable of changing its shape in order that it can be adapted to various hand sizes. In this embodiment the finger tips will make indententions in the surface of the dumbbell and press the ball up towards the curve of the fingers whereby the dumbbell is held more firmly. On top of that the dumbbell is supplied with a safety device which makes it very useful in connection with the above mentioned exercises, just as the safety device provides a further protection against slippage or injuries. Finally, the dumbbell is designed in a shape which makes it better suited than the already available dumbbells in cases where swift and changing exercises and exercises with rotations are to be made, where the purpose is not only to strengthen the muscles of the arms and shoulders but also to strengten and stretch all the muscles of the body during total movements where many different groups of muscles are activated simultaneously.

The dumbbell according to the invention is characteristic in that the dumbbell is globular or approximately globular and in that the dumbbell has such a size that the main part of the dumbbell is kept in the hollow of the closed hand, and in that one or more straps or bands keep the dumbbell to the palm of the hand or to the palm of the hand as well as to the forearm so that the dumbbell cannot fall out of the hand. Moreover, the dumbbell absorbs any impact and it is yielding to such an extent that the outer shell can be squeezed together and to a certain extent be shaped by the fingers of the hand.

The dumbbell is moreover covered by a splinter-proof material (leather, artificial leather, foam rubber or any other soft and plastic material) in order that any user who makes fitness and/or muscle training can knock two dumbbells—one in each hand of the body—against each other with no risk of splinters. The athlete can thus make physical exercises with the dumbbells with the intention of the dumbbells hitting against one another. Since the dumbbells in a special embodiment to a large extent will change their shape when colliding, the athlete will, when using this dumbbell, neither sense nor receive such a heavy impact when the dumbbells hit each other as he would if using the traditional dumbbells. The risk of injuries when dropping a dumbbell over a foot or body is also reduced due to the highly pliant and impact absorbing construction of the dumbbells.

Since the dumbbells according to the invention are maintained in place in the hand so that the risk of the dumbbell slipping out of the hollow of the half closed hand becomes minimal, this moreover means that the athlete can make very large movements of body and arms without dropping the dumbbell. This means that it will become possible to train the muscles at different extreme positions and to train the muscles during very swift movements. Because the risk of losing the dumbbells becomes next to none, it will also be possible to make fitness excercises of longer duration, such as jumping and running while using the dumbbells at places where many people work close to each other.

A further characteristic of the dumbell is its globular or globular-like shape making it very suited for rhythmic gymnastics or gymnastics in general, where fast and changing movements between different levels of movement are made. The dumbbell can be designed to be so yielding that it is not alltogether globular when lying on a levelled surface because the weight against the underlying surface will flatten the dumbbell downwardly. When the dumbbell is grasped the press of the fingers around the yielding surface of the dumbbell will recreate the globular shape.

The known dumbbells with a narrow handle and two weight members or two weight discs in the sides do not render such gymnastic exercises as those mentioned above pleasant to do, because the main part of the heavy part of the weight will be outside the hand of the user when the dumbbell is held. By certain exercises, such as rotary movements around a diagonal axis of the forearm, this will cause great wear on the sinews of the hand. A cylindrical shaped dumbbell will partly solve this problem, but a cylindrically shaped dumbbell will have the disadvantage that its moment of inertia will alter depending on whether an exercise is performed in the longitudinal direction of the dumbbell parallel to the longitudinal axis of the dumbbell or whether the movement is made at right angles to the longitudinal axis of the hand.

By rotary movements the moment of inertia will also vary depending on whether the rotation is made around the longitudinal axis of the dumbbell or whether the rotation is made around the transverse axis of the dumbbell. The problem with the varying moment of inertia is solved with the globular dumbbell according to the application described here, in that the moment of inertia of the globular dumbbell will be the same, no matter the direction of movement. The athlete will with the dumbbell described here be able to make movements that are more pleasant and more natural than with the traditional dumbbells, because the heavy substance of the dumbbell is found in the hollow of the hand, just as the centre of gravity of the globular dumbbell will remain at the same place in the hand no matter the direction of movement of the arm. This is especially important when swift changes of movement with the dumbbell are made in the course of an unfinished course of movement. Moreover, the globular dumbbell will give a lower strain on more of the sinews of the hand, when certain swinging or rotary movements are made. This contributes to reducing wear on several of the sinews of the hand and forearm.

Figure 2:
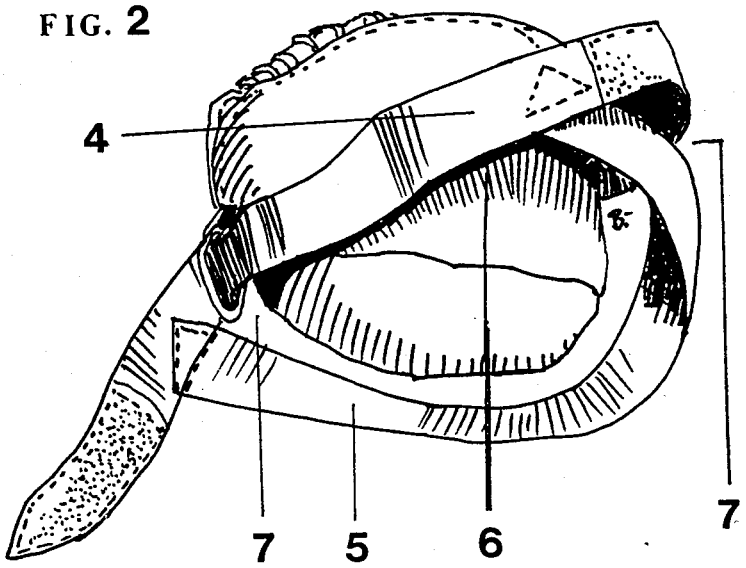

The dumbbell according to the application will now be described in further detail with reference to the drawing, in which FIG. 1 shows a sectional view of the dumbbell with strap, and FIG. 2 shows a dumbbell from an inclined angle from above and from the side with a double system of straps.

According to the invention a simple embodiment of the dumbbell consists according to the invention in that it is globular and can be held by one hand in order that at least half of the dumbbell is found in the hollow of the hand. This hollow is surrounded by the palm and fingers and extends from the carpus and outwards to an imaginary line connecting the fingers. According to FIG. 1 the actual dumbbell consists of a heavy inner core (1), which is globular, i.e. a lump, in shape; or approximately globular and around which there is a protective layer (2). This protective layer can be foam rubber or any other strong plastic material capable of being formed by the hand. If the heavy core itself consists of a malleable substance such as sand, metal particles or another heavy material capable of being formed, the protective layer (2) may be left out altogether or merely be a thin piece of textile, a thin plastic material or another thin material. On the outside the dumbbell is covered by a soft and splinter-proof shell i.e. envelope, (3) of leather, artificial leather or another highly pliant material. On the surrounding shell one end of a strap (4) and, at point spaced therefrom, a buckle ring (4*a*); are attached for maintaining the dumbbell on the. palm or the palm and wrist. In FIG. 1 is shown a simple embodiment with a single strap which is fastened across the back of the hand of the user. This strap (4) can be tied by means of a velcro fastening device or by means of another traditional means of releasable fastening.

In another embodiment there can be two or more straps. One of these straps can be tied around the back of the hand to the four fingers as in the embodiment above, while another strap can be tied around the thumb or around the wrist (or there may be additional straps around thumb as well as wrist).

In a special embodiment of the dumbbell according to the application (cf. FIG. 2) it is possible in one single operation to loosen or fasten the strap around the back of the hand as well as the strap around the wrist in one and the same movement merely by loosening or fastening a single strap. This embodiment can be carried out in several ways, e.g. with a strap sling (5) which at each of its two ends is attached to the strap (4) extending across the back of the hand and which secures the dumbbell to the back of the hand over four of the five fingers of the hand, thumb excluded. One part of the strap sling (5) is attached at an inclined angle to the strap (4) at the end where this is attached to the ball, while the other part of the strap sling (5) is attached to the outer part of the strap (4).

When the strap (4) is opened the dumbbell is applied according to the following instructions: Pass the five fingers of the hand across the strap sling (5), then place the thumb outside the strap (4) in the space (7), while placing the other four fingers in the opening (6) created between the outside (3) of the dumbbell and the strap (4). The hand will then be able to grasp around the round dumbbell and surround this. By catching the loose tip at the outer end of the strap (4) with the fingers of the other hand and tightening this strap across the other end piece of the strap by means of a velcro lock or another ordinary means of fastening, the two ends of the strap sling (5) will cross over the back of the hand in such a manner that the strap (5) will pass around the distal wrist end of the forearm and hold the dumbbell to the user's wrist. The other strap (4) will secure the dumbbell to the back of the hand in such a manner that the dumbbell will be in the palm of the hand or very close to this. Should the person lose his grip around the dumbbell, the fingers need merely again grasp around the dumbbell because this is still kept fastened to the palm of the hand.

In a more simple embodiment there may on the surface of the dumbbell be secured one or two diagonal straps extending diagonally and being attached to the strap (4). By placing the thumb in the space between the two straps and the other four fingers of the hand in the opening (6) in the strap (4), as mentioned above, this dumbbell may also be secured to the palm as well as to the wrist.

In the shown embodiments only three layers are shown in the actual dumbbell and one or two straps on the outside of the dumbbell, but there is no reason why the dumbbell cannot consist of fewer or more layers. Also, the dumbbell may well be provided with more safety straps or safety bands.

In the shown embodiments a globular dumbbell is shown. It is possible, however, that the dumbbell, the major part of which being inside the hand and surrounded by the hand and having safety straps may be more or less round or rounded or have a completely different shape.

I claim:

1. Handheld exercise device comprising a lump-shaded core of a heavy material which is confined within an envelope, fastening strap means being provided for releasably fastening the device to a hand, characterized in that said strap means comprises a first strap which is so connected to the envelope as to extend over the back of a hand when the core is grasped in the palm of said hand, and a second strap both ends of which are so connected to said first strap as a pass around the wrist of said hand, means being provided for tightening said first strap around the hand.

2. Handheld exercise device according to claim 1, characterized in that one end of said first strap is secured to said envelope and that said first strap passes through a buckle ring secured to the envelope at a point spaced from said first end of said first strap, the free end portion of which is adapted to be releasably fastened to the portion of the strap which is positioned between said buckle ring and said first end secured to the envelope, both ends of said second strap being secured to said first strap at spaced points positioned on respective sides of said buckle ring.

3. Handheld exercise device according to claim 1, characterized in that said heavy material is malleable and that said envelope is a bag of pliant material.

4. A handheld exercise device, comprising:

a heavy core means which is at least approximately globular in shape for grasping in a hand;

an envelope about the core for grasping by the hand therewith; and fastening strap means connected to the envelope for releasably fastening the envelope to the hand when the core and envelope are grasped thereby, the fastening strap means comprising a first strap for then extending over the back of the hand, a second strap connected to having both ends the first strap for then passing around the wrist of the hand, and tightening means for tightening at least the first strap over the back of the hand.

5. The handheld exercise device of claim 4, wherein one end of the first strap is connected to the envelope, wherein the tightening means comprises a buckle ring connected to the envelope at a point spaced from the one end of the first strap through which the opposite end of the first strap passes for one portion of the first strap to extend between the one end and the buckle ring over the back of the hand and another portion, to extend from the buckle ring to the opposite end of the first strap, and releaseble fastening means for releasably fastening the other portion of the first strap to the one portion thereof, and wherein one end of the second strap is connected to the one portion of the first strap and the opposite end of the second strap is connected to the other portion of the first strap.

6. The handheld exercise device of claim 4, wherein the core comprises a malleable material and the envelope comprises a pliant material, both with reference to the hand.

7. The handheld exercise device of claim 5, wherein the core comprises a malleable material and the envelope comprises a pliant material, both with reference to the hand.

* * * * *